US005996932A

United States Patent [19]

Wang

[11] Patent Number: 5,996,932

[45] Date of Patent: Dec. 7, 1999

[54] TAPE DISPENSER HAVING A LIQUID-FILLED DISPLAY PORTION

[76] Inventor: Paul Wang, 13620 Benson Ave., Chino, Calif. 91710

[21] Appl. No.: 09/130,813

[22] Filed: Aug. 7, 1998

[51] Int. Cl.[6] ..... B65H 19/00

[52] U.S. Cl. ..... 242/598.5

[58] Field of Search ..... 242/598.5, 598.6, 242/599.3, 599.4; 273/457; 472/67

[56] References Cited

U.S. PATENT DOCUMENTS 3,037,415 6/1962 Wyant ..... 242/563
3,263,805 8/1966 Hollins ..... 242/597.8
3,403,869 10/1968 Marchisen et al. ..... 242/597.8
4,941,590 7/1990 Pantaleo et al. ..... 273/457
5,083,717 1/1992 Samuelson et al. ..... 242/588.6

*Primary Examiner*—John P. Darling
*Attorney, Agent, or Firm*—Steins & Associates

[57] ABSTRACT

A dispenser includes a chamber filled with fluid and cascading contents, such that when tape is dispensed, the chamber rotates, thereby causing the cascading contents to cascade through the fluid. Furthermore, the cascading chamber assembly includes a display portion and a clear chamber cover whereby indicia inscribed on the display portion are viewable through the chamber cover. Also, the dispenser may include a sound-producing mechanism for producing an entertaining sound or sounds when the chamber rotates.

9 Claims, 5 Drawing Sheets

TAPE DISPENSER HAVING A LIQUID-FILLED DISPLAY PORTION

BACKGROUND OF THE INVENTION

1. Field of the Invention

This invention relates generally to dispensers for tape and other flat materials dispensed from rolls and, more specifically, to a Tape Dispenser Having a Liquid-Filled Display Portion.

2. Description of Related Art

Tape dispensers have been in existence for as long as adhesive tape rolls have existed. A common design includes a housing that is split in two parts (that snap together to form a single housing). Within the housing is held a roll of tape; the user merely needs to pull on the end of the tape strip until the desired length is obtained. The tape strip is then torn across a cutting member, thereby cutting the unrolled strip free from the roll.

Children commonly use tape for arts and crafts and other school assignments. To date, however, there has been no tape dispenser design that would be particularly attractive to children. While it is typical for tape dispensers to have custom-shaped or -colored housings, until now there has been no real innovation to the dispenser design. It would provide much enjoyment for children (and therefore increased utility) if there were a tape dispenser that provided entertainment through visual action and even sound emissions when the tape is dispensed.

SUMMARY OF THE INVENTION

In light of the aforementioned problems associated with the prior devices, it is an object of the present invention to provide a Tape Dispenser Having a Liquid-Filled Display Portion. It is a further object that the dispenser include a chamber filled with fluid and cascading contents, such that when tape is dispensed, the chamber rotates and causes the cascading contents to cascade through the fluid. It is another object that the cascading chamber assembly include a display portion and a clear chamber cover whereby indicia inscribed on the display portion are viewable through the chamber cover. It is a still further object that the dispenser include a sound-producing means for producing an entertaining sound or sounds when the chamber rotates.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Tape Dispenser Having a Liquid-Filled Display Portion.

Figure 1:
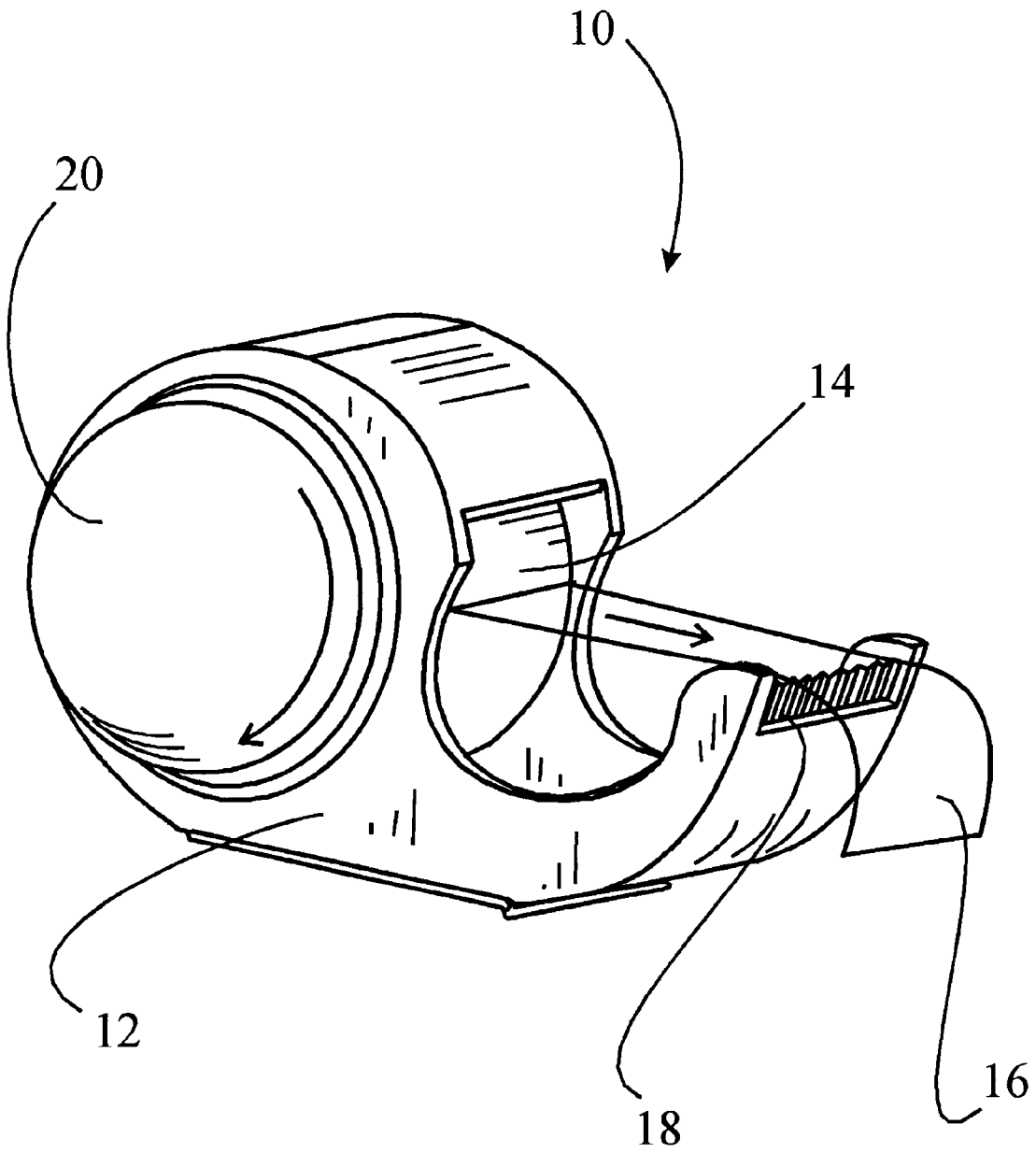
FIG. 1 is a perspective view of the tape dispenser having the liquid-filled display portion of the present invention.
Figure 2:
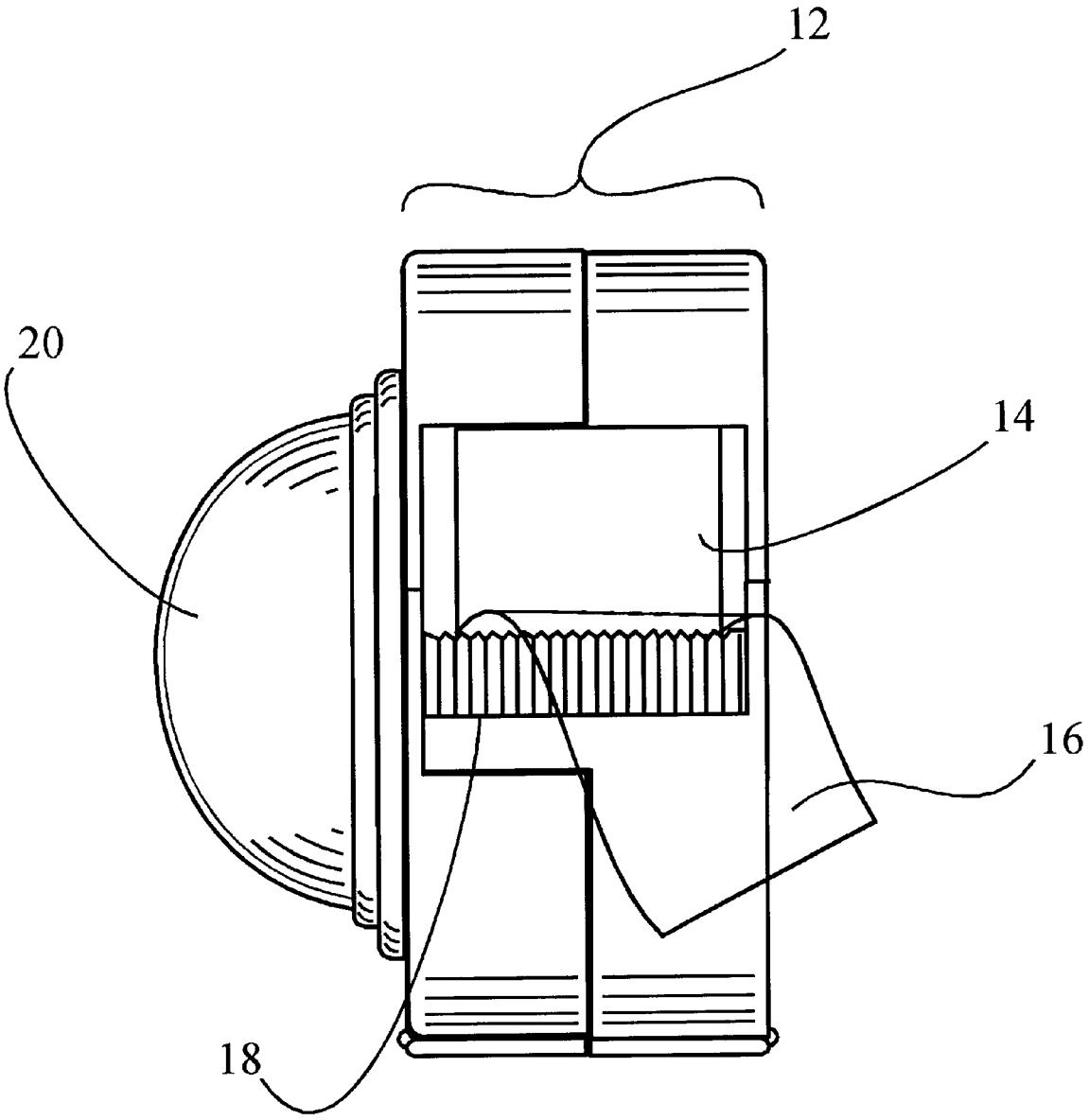
FIG. 2 is a side view of the tape dispenser of FIG. 1.

The present invention can best be understood by initial consideration of FIGS. 1 and 2. As with a conventional tape dispenser, the present invention comprises a housing 12, typically made from colorful plastic, in which a tape roll 14 is placed. To dispense tape, the tape filament 16 is pulled until the desired length is obtained, at which time the filament 16 is torn across the cutting means 18. As depicted, the cutting means 18 is simply a serrated cutting edge—in other embodiments, the cutting means 18 may be a blade, shears, or other device configured to cut the dispensed item. The innovation of the present invention is the cascading chamber 20. The cascading chamber 20 rotates when the tape filament 16 is pulled; as it rotates, it produces a pleasing visual effect. It should be appreciated that the dispenser 10 of the present invention is not limited to simply dispensing tape; other roll-dispensable materials might be dispensed from other device designs.

Figure 3:
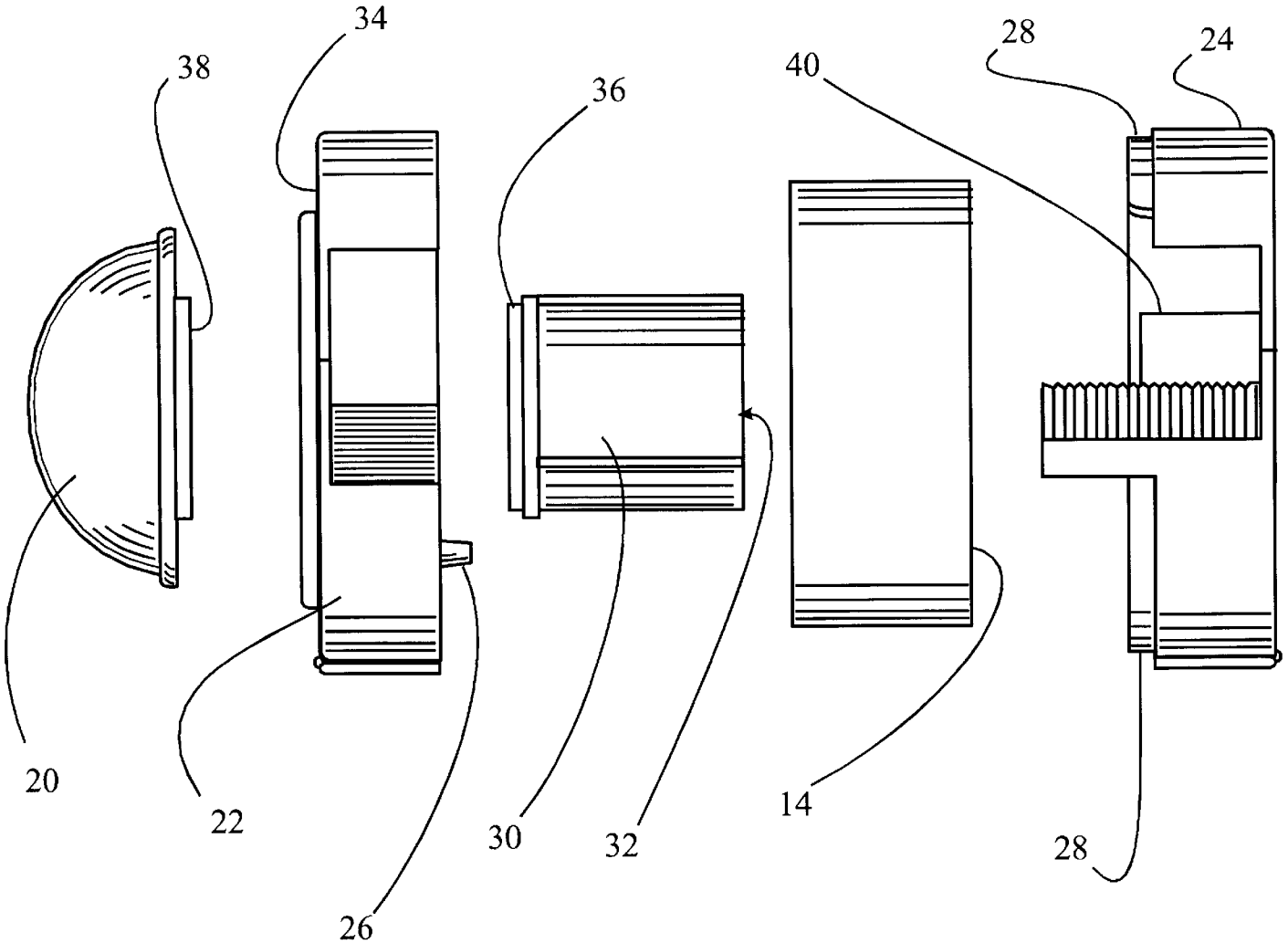
FIG. 3 is an exploded side view of the tape dispenser of FIGS. 1 and 2.

FIG. 3 depicts additional components of the present invention; it is an exploded side view of the tape dispenser 10 of FIGS. 1 and 2. As can be seen, the housing comprises a front shell 22 and a rear shell 24. The front and rear shells 22 and 24 releasably snap together through alignment and cooperation between the alignment pin 26 and the alignment fin 28 (which essentially encircles the rear shell 24). Just as with a conventional tape dispenser, the two shells 22 and 24 snap apart in order to remove and replace the tape roll 14.

The tape roll 14 is placed upon the spindle 30, which operates as an axle around which the tape roll 14 rotates to dispense tape. The spindle 30 is typically a hollow tube-like structure that may also include a sound-producing means 32 mounted thereon to produce sounds when the spindle 30 rotates during tape dispensing. The spindle 30 extends through an aperture formed in the face 34 of the front shell 22, where the spindle ring 36 engages the chamber ring 38. The spindle ring 36 is typically glued or otherwise bonded to the chamber ring 38 to form a durable bond, while still permitting the spindle 30 to rotate. The cascading chamber 20, or chamber assembly, is typically a dome-shaped protrusion extending outwardly from the face 34 of the front shell 22.

At its distal end, the spindle 30 rides on a post 40 extending outwardly from the rear shell 24. The post 40 is essentially a cylindrical post which extends into the hollow core of the spindle 30 when the front and rear shells 22 and 24 are snapped together. The hollow core of the spindle 30 is dimensionally configured so that the spindle 30 can freely rotate around the post 40; the post 40 provides stability to the free end of the spindle 30.

Figure 4:
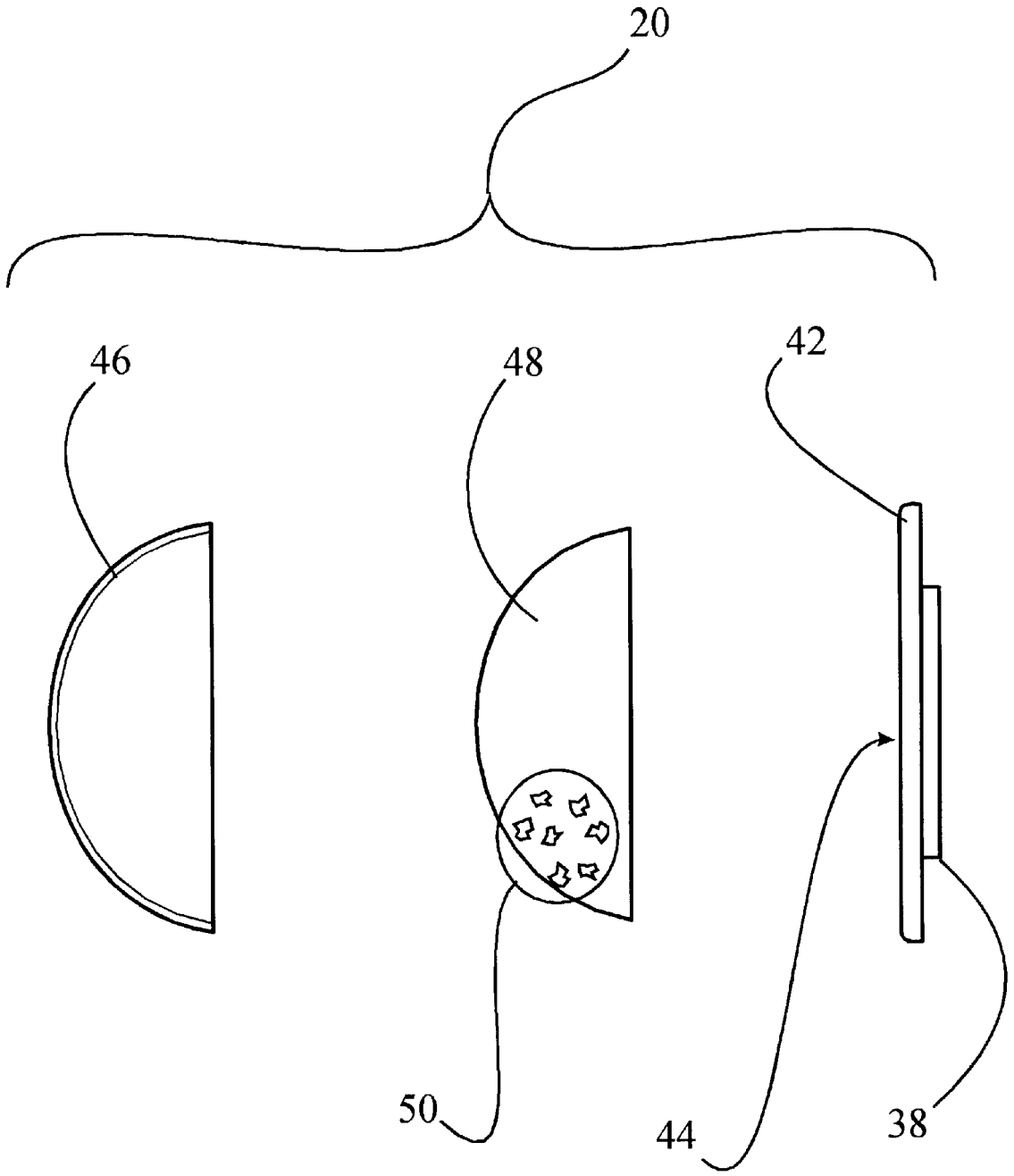
FIG. 4 is an exploded side view of the chamber assembly of the tape dispenser of FIGS. 1–3.
Figure 5A:
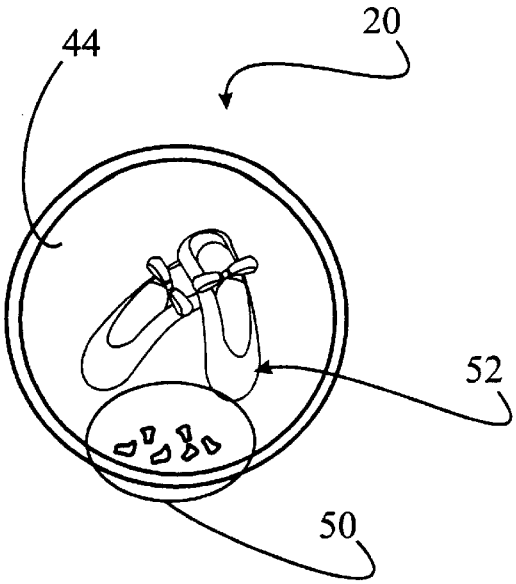
FIGS. 5A–5C are front views of the chamber assembly of FIG. 4, depicting the cascading action of the chamber contents.
Figure 5B:
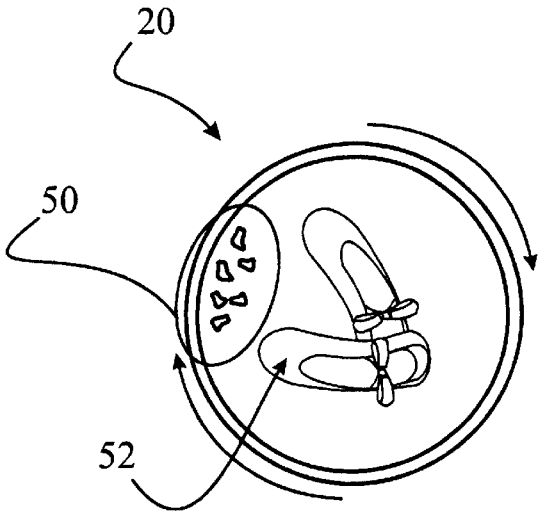
Figure 5C:
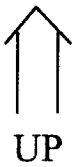
Figure 5C:
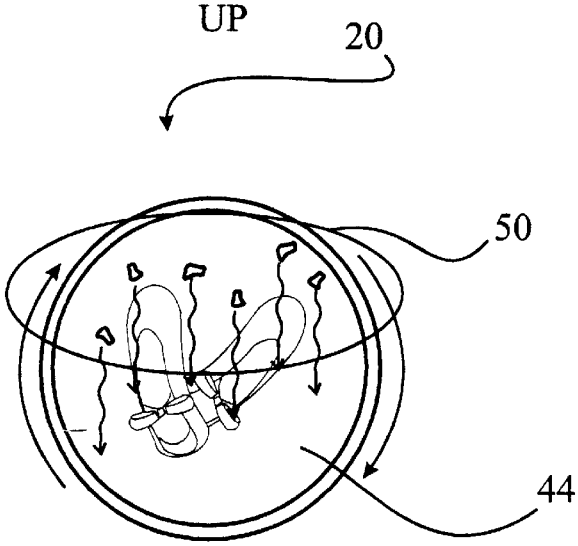

Now turning to FIG. 4, we can further examine the chamber assembly 20. FIG. 4 is an exploded side view of the chamber assembly 20 of the tape dispenser of FIGS. 1–3. The assembly comprises a chamber base 42, which includes a chamber ring 38 as described previously, and a display surface 44 on its opposite side. A chamber cover 46 is bonded to the chamber base 42 to form a chamber within which fluid contents 48, such as water, oil or other fluid, and cascading contents 50 are captured. The chamber cover 46, in the present embodiment, is a hemispherically-shaped clear plastic dome; other shapes and configurations might be used to provide a pleasing effect. It should be understood that because the fluid contents 48 and the chamber cover 48 are substantially clear, the cascading contents 50 and the display surface 44 can be viewed therethrough. FIGS. 5A–5C depict how this might appear in operation.

FIGS. 5A–5B are front views of the chamber assembly 20 of FIG. 4, depicting the cascading action of the chamber contents. As can be seen, decorative indicia 52 are inscribed on the display surface 44, and are viewable through the chamber cover and fluid contents. The cascading contents 50 are structurally more dense than the fluid contents, such that when the chamber assembly 20 is at rest, the cascading contents 50 will rest on the bottom of the chamber. When the tape is dispensed, thereby causing the chamber assembly 20 to rotate, the cascading contents 50 are drawn upwardly by flow of the fluid contents, as shown in FIG. 5B. Finally, as the cascading contents 50 begin to reach the apex of their rotation, they are forced to cascade down through the fluid contents, thereby providing a pleasing visual effect. The cascading contents 50 could be any of a virtually limitless variety of trinkets or other decorative items that may provide a pleasing visual effect as they cascade downwardly in front of the indicia 52.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An improved dispenser for at least one roll of tape, each said roll having a center aperture, comprising:

a body configured to contain and dispense each tape roll;

a rotatable spindle attached to said body and extending through the aperture; and at least one chamber assembly containing cascading contents therein, said assembly attached to said spindle whereby said chamber assembly rotates with said spindle.

2. The dispenser of claim 1, wherein said chamber assembly further comprises:

a chamber base, attached to said spindle;

a substantially transparent chamber cover attached over said chamber base to form a chamber; and cascading contents contained in said chamber.

3. The dispenser of claim 2, wherein said chamber base further comprises a display surface for displaying indicia thereon, said indicia being visible through said chamber cover.

4. The dispenser of claim 3, wherein said cascading contents comprises:

liquid having a liquid density; and cascading trinkets immersed in said liquid and having a density greater than said liquid density, whereby said trinkets will drop through said liquid.

5. The dispenser of claim 4, wherein said chamber cover comprises a hemispherical shape and a circular edge attached to said chamber base.

6. The dispenser of claim 5, wherein said body comprises a front shell and a rear shell, said front and rear shells snapped together.

7. The dispenser of claim 6, wherein said front shell includes face having a recessed portion for receiving said chamber base.

8. The dispenser of claim 7, wherein:

said spindle comprises a longitudinal bore therethrough; and said rear shell further includes a post formed thereon for accepting said bore thereover.

9. The dispenser of claim 1, further comprising sound-producing means, said sound-producing means configured to produce sound when said spindle is caused to rotate.

* * * * *